US005647485A

United States Patent [19]

Verrangia

[11] Patent Number: 5,647,485

[45] Date of Patent: Jul. 15, 1997

[54] DISPLAY SYSTEM FOR HAIR SWATCHES

[75] Inventor: Thomas V. Verrangia, Baldwin, N.Y.

[73] Assignee: L'Oreal S.A., Paris, Cedex, France

[21] Appl. No.: 588,858

[22] Filed: Jan. 19, 1996

[51] Int. Cl.[6] ..... B65D 85/00; B65D 69/00

[52] U.S. Cl. ..... 206/733; 206/388; 206/775; 206/581; 206/459.5; 132/221; 132/276

[58] Field of Search ..... 206/81, 388, 495, 206/227, 733, 734, 730, 581, 823, 459.5, 457; 132/221, 53, 212, 273–284; 242/400.1, 405, 405.1; D11/200, 201; 24/543, 336; 211/184, 94

[56] References Cited

U.S. PATENT DOCUMENTS

| | | | |
|---|---|---|---|
| 650,630 | 5/1900 | Chamberlain | 206/388 |
| 1,013,346 | 1/1912 | Benjamin | 132/278 |
| 1,957,256 | 5/1934 | Frey | 206/388 |
| 4,373,632 | 2/1983 | VanZandt | 206/457 |
| 4,896,779 | 1/1990 | Jureckson . | |
| 4,978,008 | 12/1990 | Dalbo et al. | 206/574 |

FOREIGN PATENT DOCUMENTS

| | | | |
|---|---|---|---|
| 608859 | 8/1926 | France | 132/278 |

*Primary Examiner*—Paul T. Sewell
*Assistant Examiner*—Nhan T. Lam
*Attorney, Agent, or Firm*—Brumbaugh, Graves, Donohue & Raymond

[57] ABSTRACT

A swatch display system and a swatch cassette for use with a display for selling coloring product. The swatch cassette comprises a cassette insert formed to removeably hold and display horizontally a swatch, and a bezel for removeably holding the cassette insert and removeably securing the bezel to the display.

19 Claims, 6 Drawing Sheets

DISPLAY SYSTEM FOR HAIR SWATCHES

BACKGROUND OF THE INVENTION

This invention relates to display systems for saleable coloring products. The systems include swatches intended to reflect the true color resulting from use of the coloring product being sold. The swatches may be attached to trays holding the product, they may be attached as part of a shelf front, or corrugated display (without a tray), or as part of a vacuumed formed display (featuring a central area for color sampling), or as part of a point-of-sale signage, hanging from or affixed to a display.

One of the most popular types of swatches used in such display systems includes hair swatches used in retail stores which sell hair coloring products. The swatches replicate the human hair and are colored to reflect the true color resulting from use of the associated retailed product, i.e., the hair coloring product intended to be sold. Hair swatches to date have been displayed in a "vertical presentation" in which they are attached vertically to the tray in a manner which leaves the swatches exposed and subject to pilferage.

Another problem with the prior art vertical presentation displays is that when the trays are aligned side by side the hair swatches are presented in a manner which makes it difficult to realize the actual gradation, i.e., blending, of the hair color resulting from use of the various products being sold.

FIGS. 1 and 2 illustrate representative prior art systems. In FIG. 1 hair swatch 10 is attached vertically to anchor 12, typically by glue or another known adhesive method. The swatch 10 replicates the color grade of the respective hair product to be sold. Anchor 12 is attached by a snap or other known connector to the face 16 of tray 18. Tray 18 holds in area 20 the respective hair coloring product (not shown) to be sold.

By displaying the hair swatch in the manner shown in FIGS. 1 and 2 it can readily be seen that the hair swatch is left dangling, enticing physical contacts and fostering easy theft or pilferage. Moreover, as shown in FIG. 3, when the displays are aligned side by side (as intended for the retail shelves) a true gradation or color blending of the hair colored with the various retailed products is not achieved.

It is a primary objective of the present invention to provide a hair swatch display system that solves both problems.

SUMMARY OF THE INVENTION

The present invention overcomes the prior art limitations by providing a unique swatch display system with a horizontal presentation and particularly a unique swatch cassette comprising two interrelated components, a bezel and cassette insert. Preferably, the cassette insert is designed to display a swatch horizontally along the front of the insert with the swatch ends engaged securely to the rear of the cassette insert by hingedly attached flap covers placed in closed position preferably by use of retaining tabs and slots. The cassette insert removably snaps into the bezel by use of two strategically placed catch levers. The bezel encapsulates and protects the insert and allows for product designation. The bezel itself removedly snaps into the face of a display by use of interrelated catch levers and receivers.

The cassette insert preferably includes on its face two ridges defining a groove for placement of the swatch and maintaining the groove offset from the face of the insert such that the swatch, when presented horizontally, is substantially flush with the face of the bezel.

By employing the swatch cassette of the present invention the problems of the prior art are overcome. Namely, pilferage is less likely to occur and unique color sampling by range and gradation is achieved. In addition, the present invention provides a more aesthetically pleasing and easily changeable display system.

BRIEF DESCRIPTION OF THE DRAWING

Further objects, features and advantages of the invention will become apparent from the following detailed description taken in conjunction with the accompanying figures in which.

Figure 1:
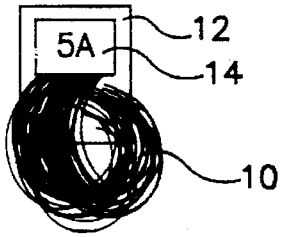
FIG. 1 is a front view of a portion of a prior art tray with a hair swatch display.
Figure 2:
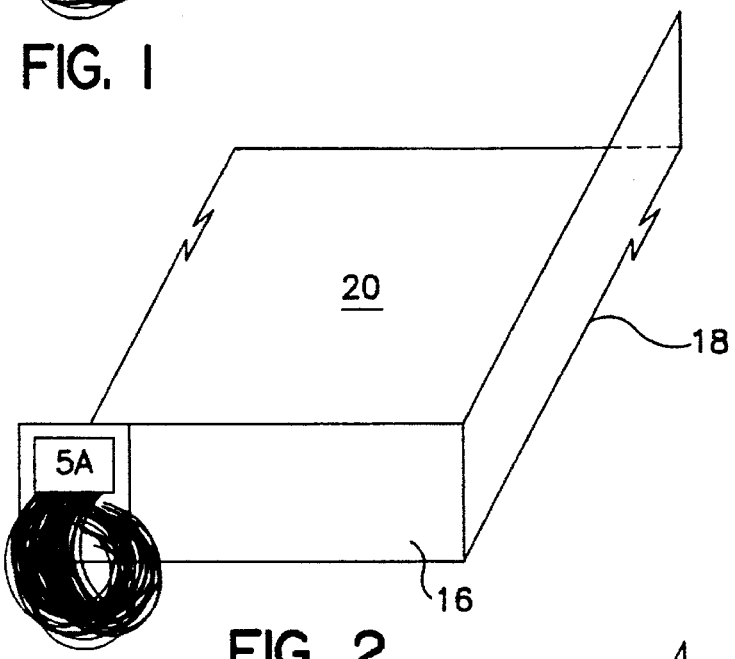
FIG. 2 is a perspective view of a prior art tray with a hair swatch display.
Figure 3:
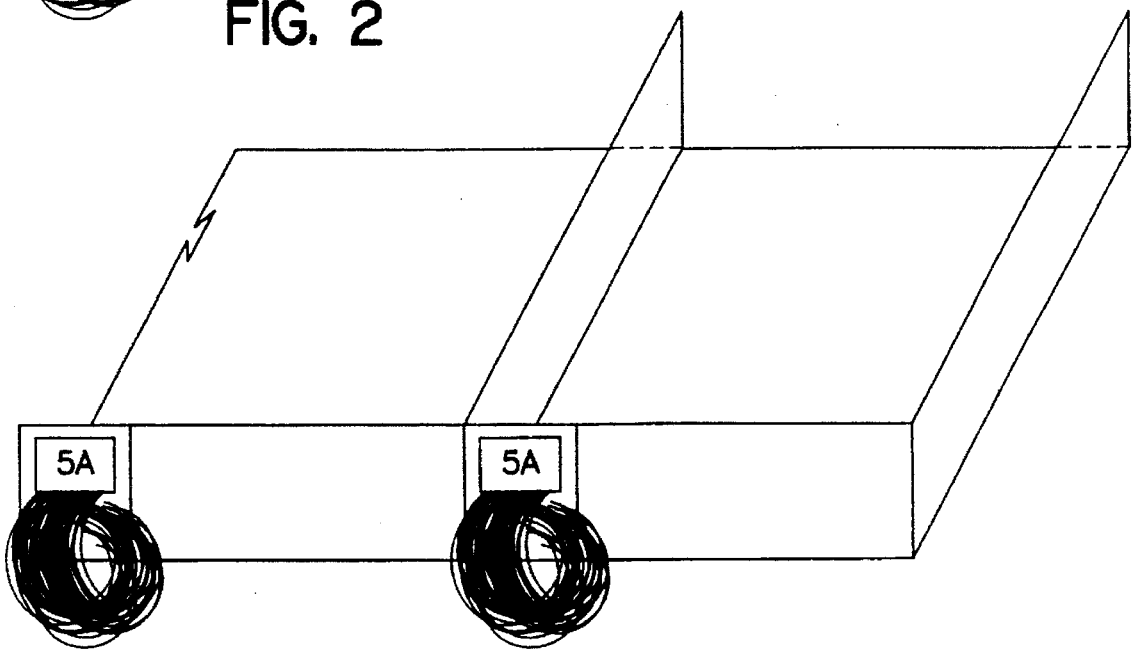
FIG. 3 is a perspective view of a prior art hair swatch display system showing two aligned interconnected display trays.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION OF THE INVENTION

Figure 4:
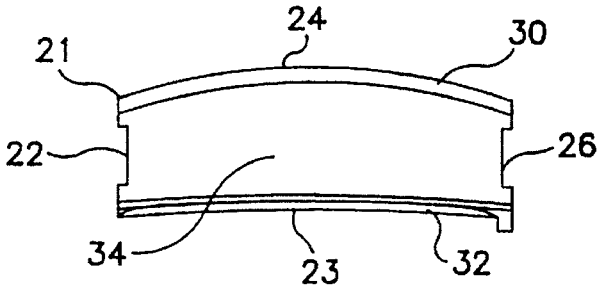
FIG. 4 is a front view of the cassette insert of the present invention.
Figure 9:
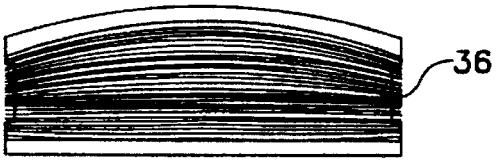
FIG. 9 is a front view of the cassette insert of the present invention with a hair swatch display.
Figure 10:
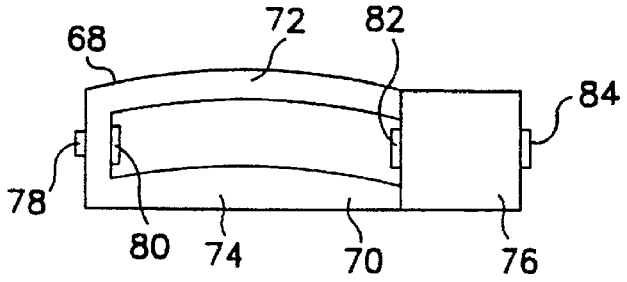
FIG. 10 is a front view of the bezel of the present invention.
Figure 11:
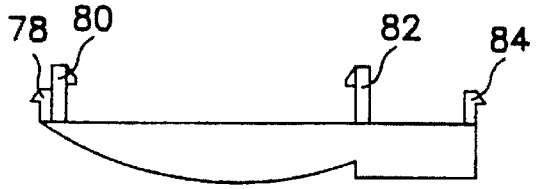
FIG. 11 is a top view of the bezel of the present invention.
Figure 12:
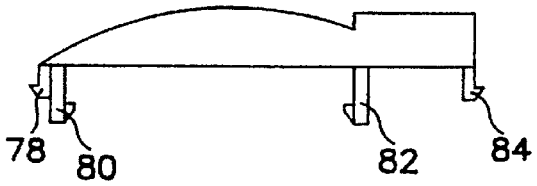
FIG. 12 is a bottom view of the bezel of the present invention.
Figure 13:
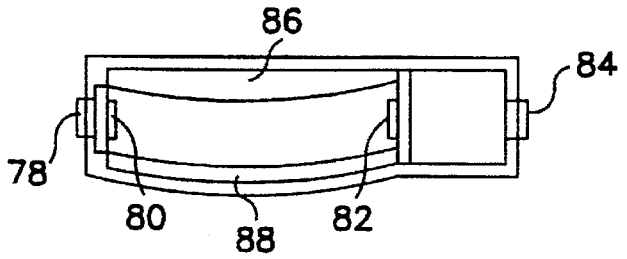
FIG. 13 is a back view of the bezel of the present invention.

FIGS. 4 to 9 illustrate a preferred embodiment of the cassette insert of the present invention. As can be seen in FIG. 4 cassette insert 21 is preferably substantially rectangular with side edge 22, top edge 24, side edge 26 and bottom edge 28, except that edge 24 is preferably slightly curved, and side edges 22, 26 are slightly undercut. Clear plastic or similar material is preferable. Top 24 and bottom 28 edges have ridges 30 and 32 either along the edge (as shown along top edge 24) or offset from the edge (as shown off bottom edge 28). The ridges 30, 32 define groove 34 for accommodating, guiding and holding a hair swatch 36, as shown in FIG. 9. It should be understood that while the present invention is described with respect to a hair swatch, other types of swatches, such as a cloth swatch or the like, may be utilized.

Figure 5:
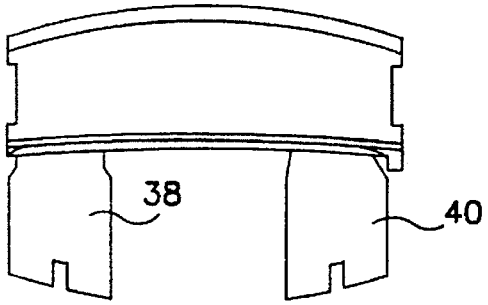
FIG. 5 is a front view of the cassette insert of the present invention, showing its rear flap covers in open position.
Figure 6:
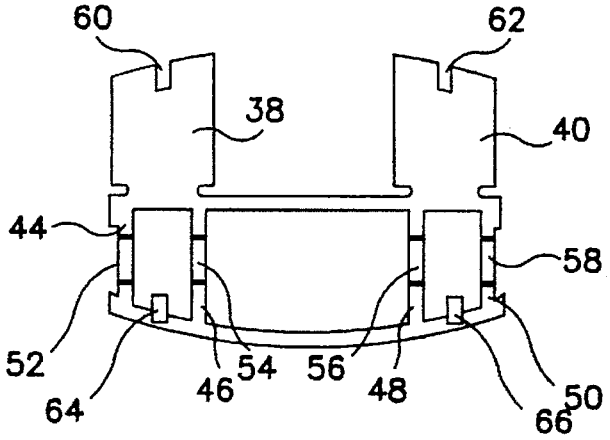
FIG. 6 is a back view of the cassette insert of the present invention with open flap covers.
Figure 7:
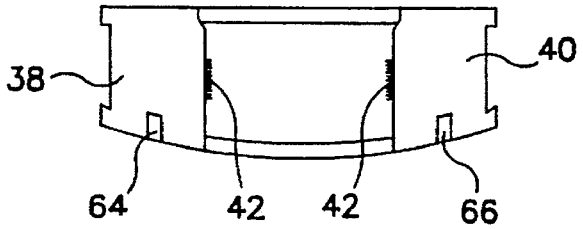
FIG. 7 is a back view of the cassette insert of the present invention with closed flap covers.
Figure 8:
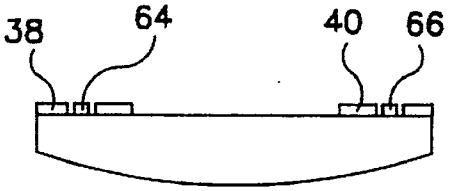
FIG. 8 is a top view of the cassette insert of the present invention with flap covers in closed position.

FIGS. 5 to 8 show, among other components, the retaining flap covers 38, 40 of the present invention. These covers 38, 40 extend from and are hingedly attached to the back of the bottom of the insert 21. FIGS. 5 and 6 show the retaining flap covers 38, 40 in open position and FIG. 7 shows these covers in closed position securing the hair swatch ends 42.

The back of the insert 21 is illustrated in FIG. 6. Retaining walls 44, 46, 48, 50 are provided with undercut sections 52, 54, 56, 58 which define grooves for accommodating, guiding and holding the ends 42 of hair swatch 36. Flap covers 38, 40 are provided with slots 60, 62 which are aligned with and correspond to retaining taps 64, 66 respectively, shown also in FIGS. 7 and 8. Flap covers 38, 40 are closed by physical, frictional contact with retaining tabs 64, 66. In closed position, the covers secure the hair swatch ends 42 between the covers and undercut sections in the retaining walls.

The bezel 68 shall now be described with respect to FIGS. 10 to 14. Bezel 68 is the container or otherwise holder of the cassette insert 21 and is shaped accordingly. The bezel's front 70 has an upper 72 and lower 74 portion and side 76 portion capable of performing necessary product designation. Bezel 68 is preferably provided with catch levers 78, 80, 82 and 84.

Figure 14:
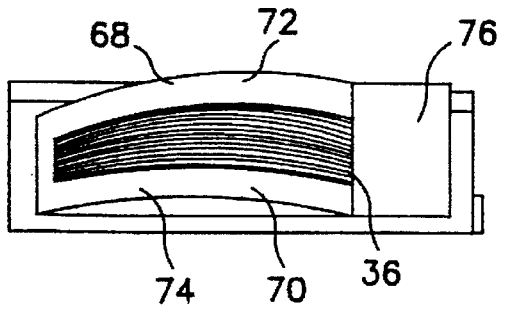
FIG. 14 is a front view of a display tray having the bezel of the present invention with the cassette insert and hair swatch.

In accordance with the present invention, catch levers 80 and 82 function to removeably secure the cassette insert 21, with the levers 80, 82 hooking under the closed cover flaps 38 and 40, respectively. Framing lips 86, 88 on the back side of the bezel 68 hold the front of the cassette insert, with the insert's ridges 30, 32 pressing against lips 88 and 86, respectively, and serving to keep the insert's groove 34 offset from the lips. In this manner, and in accordance with the present invention, not only do the ridges 30, 32 define the groove of the cassette insert for guidance of the hair swatch but they also serve to provide space between the groove 34 and the bezel 68 such the hair swatch, when in place, does not extend beyond the front of the bezel but is instead substantially flush with front 70 of the bezel 68, as shown in FIG. 14. By providing the hair swatch in horizontal fashion and flush against the bezel, the prior art problems of handling, pilferage and theft are less likely to occur.

Figure 15:
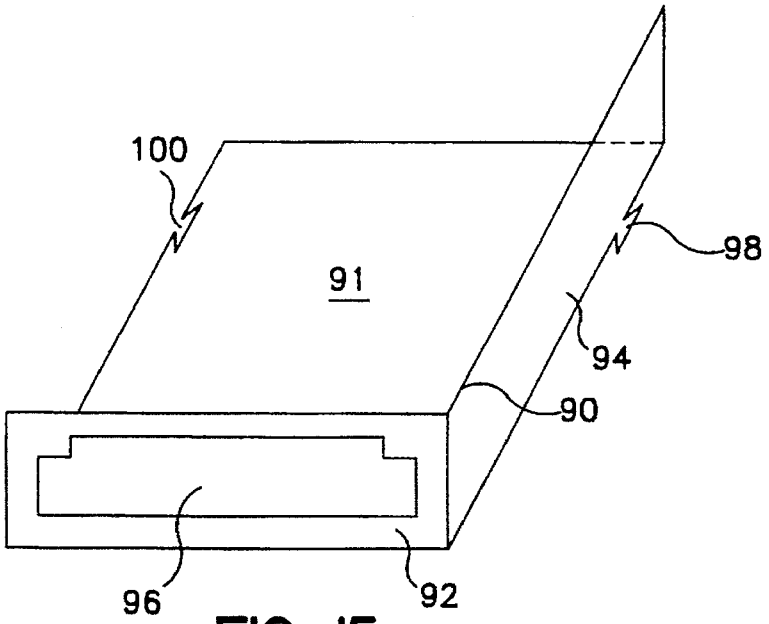
FIG. 15 is a perspective view of a display tray without the swatch cassette of the present invention.

A display tray 90 utilized with the present invention is shown in FIG. 15. It should be understood that while the present invention is described in connection with a display tray, many other applications (aside from use with trays) are possible, such as use with a shelf front, a corrugated display, a vacuumed formed display or point of sale display, as previously described.

The display tray 90 of FIG. 15 has, as is typical in prior art systems, a bottom 91, and only two walls, a front 92 and side wall 94.

The product intended to be sold (not shown) is placed in stacked arrangement on the bottom 91 of tray 90. The front 92 of the tray 90 has opening 96 shaped to receive the swatch cassette of the present invention. As in prior art systems, the tray is supplied with means 98, 100 for easily aligning side by side and removedly securing two or more trays. In this case, component 98 is conformed to fit into slot 100.

Figure 16:
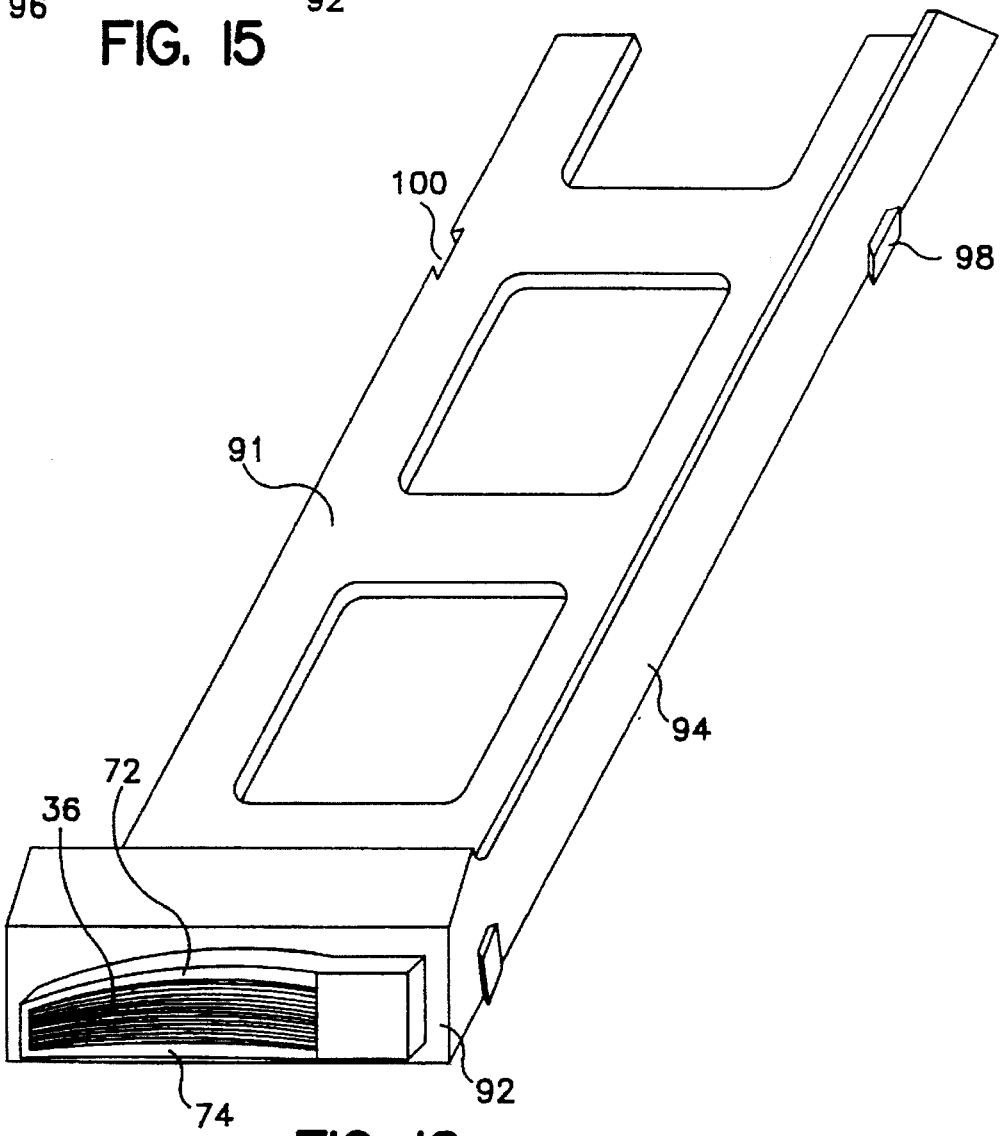
FIG. 16 is a perspective view of a tray having inserted therein the swatch cassette with hair swatch of the present invention.
Figure 17:
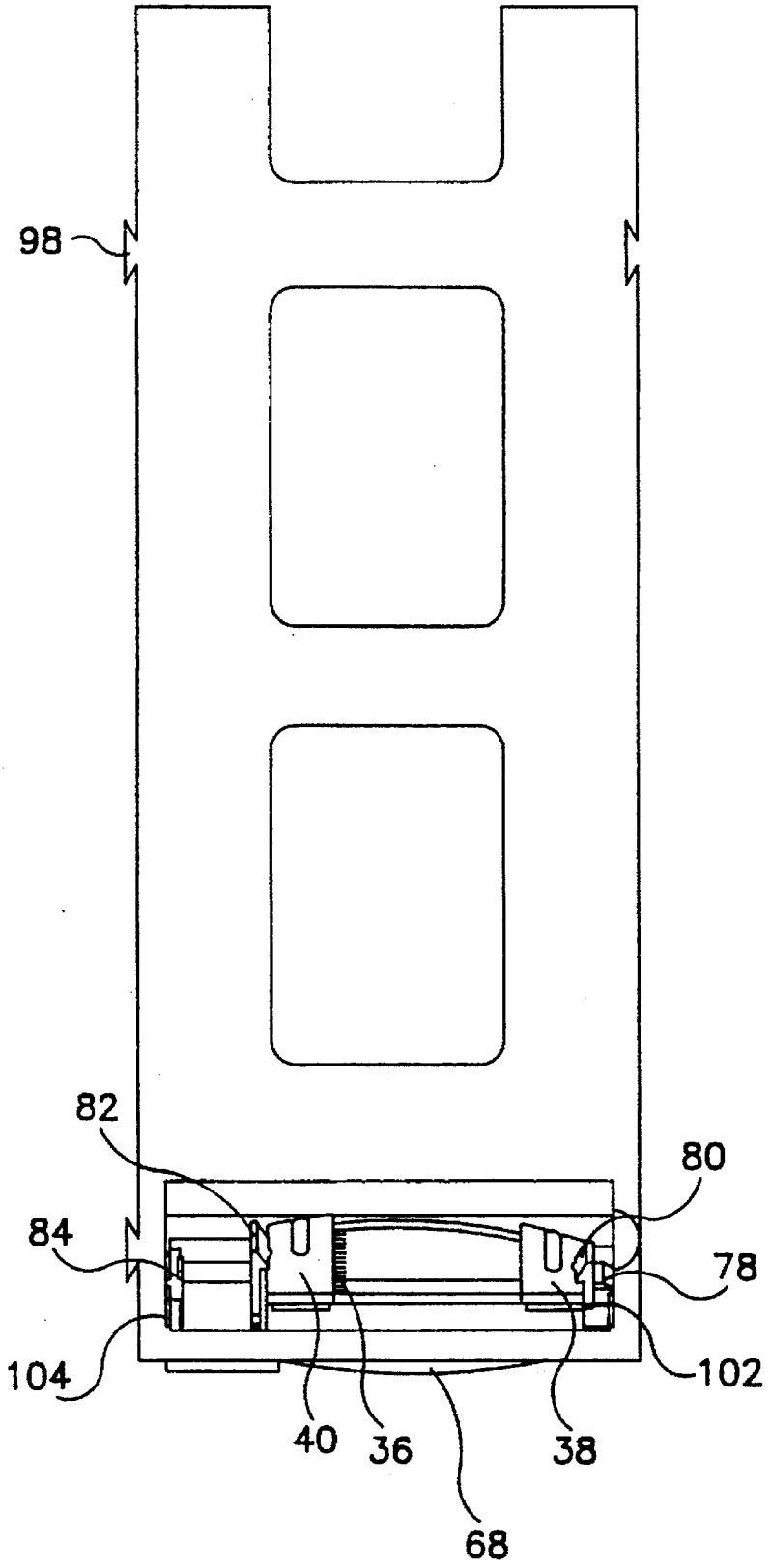
FIG. 17 is a back view of a tray having inserted therein the swatch cassette of the present invention.
Figure 18:
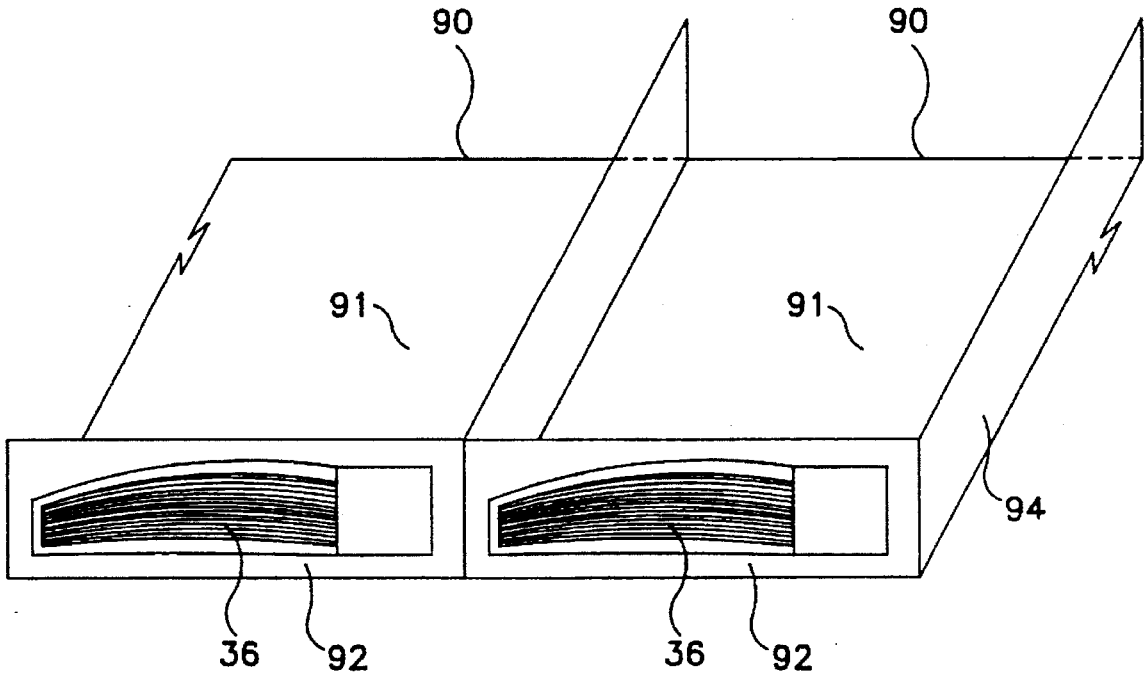
FIG. 18 is a perspective view of the hair swatch display system of the present invention showing two aligned interconnected display trays.

FIGS. 16, 17 and 18 show the display trays utilizing the swatch cassette of the present invention. The swatch cassette is inserted by use of the retaining catch levers 78 and 84 (also shown in FIGS. 10–14) which are removeably inserted in the sides of opening 96. All the levers, including 78 and 84, are pliable, and levers 78 and 84 retain the bezel by hooking behind the backsides 102, 104 respectively of opening 96.

By utilizing the present invention, as can be seen in FIG. 18, unique color sampling by range and color gradation is achieved.

Other modifications of the invention will occur to those skilled in the art and it is intended that the scope of the invention be limited only as set forth in the appended claims.

I claim:

1. A device for use with a display for selling coloring product, said device comprising insert means formed to removeably hold and display a swatch, and bezel means for removeably holding said insert means and removeably securing said insert means to said display, wherein said insert means includes at least one flap cover hingedly attached to said insert means for removeable securing the swatch to said insert means, and wherein said insert means further includes at least one retaining tab for each flap cover, each cover including a slot aligned with one of said retaining tabs for frictionally maintaining said flap cover in closed position for removeable securing the swatch to said insert means.

2. The device of claim 1, wherein said insert means includes two ridges defining therebetween a groove over which said swatch is removeably secured horizontally.

3. The device of claim 2, wherein said groove is offset from the face of said bezel means by said ridges such that said swatch is substantially flush with the face of said bezel means.

4. The device of claim 1, wherein the swatch is held and displayed horizontally.

5. The device of claim 4, wherein said insert means includes two ridges defining therebetween a groove over which said swatch is removeably secured horizontally.

6. The device of claim 5, wherein said groove is offset from the face of said bezel means by said ridges such that said swatch is substantially flush with the face of said bezel means.

7. The device of claim 6, wherein said bezel means includes catch levers for removeably holding said cassette insert and removeably securing said bezel means to said display.

8. The device of claim 7, wherein said display is a display tray.

9. A device for use with a display for holding saleable hair coloring product, said device comprising insert means formed to removeably hold and display a hair swatch, and bezel means for removeably holding said insert means and removeably securing said insert means to said display;

wherein said insert means includes at least one flap cover hingedly attached to said insert means for removeably securing the hair swatch to the insert means; and wherein said insert means includes at least one retaining tab for each flap cover, each cover including a slot aligned with one of said retaining tabs for frictionally maintaining said flap cover in closed position for removeably securing the hair swatch to the insert means.

10. The device of claim 9, wherein said insert means includes two ridges defining therebetween a groove over which said hair swatch is removeably secured horizontally.

11. The device of claim 10, wherein said groove is offset from the face of said bezel means by said ridges such that said hair swatch is substantially flush with the face of said bezel means.

12. The device of claim 9, wherein the hair swatch is held and displayed horizontally.

13. The device of claim 12 further including means for interconnecting said device to another second device for holding saleable hair coloring product.

14. The device of claim 12, wherein said insert means includes two ridges defining therebetween a groove over which said hair swatch is removeably secured horizontally.

15. The device of claim 14, wherein said groove is offset from the face of said bezel means by said ridges such that said hair swatch is substantially flush with the face of said bezel means.

16. The device of claim 15, wherein said bezel means includes catch levers for removeably holding said insert means and removeably securing said bezel means to said display.

17. The device of claim 16, wherein said display is a display tray.

18. A device for use with a display for selling coloring product, said device comprising insert means formed to removeably hold and display a swatch, and bezel means for removeably holding said insert means and removeably securing said insert means to said display, wherein said insert means includes at least one flap cover hingedly attached to said insert means for removeably securing the swatch to the insert means.

19. A device for use with a display for holding saleable hair coloring product, said device comprising insert means formed to removeably hold and display a hair swatch, and bezel means for removeably holding said insert means and removeably securing said insert means to said display, wherein said insert means includes at least one flap cover hingedly attached to said insert means for removeably securing the hair swatch to the insert means.

* * * * *

UNITED STATES PATENT AND TRADEMARK OFFICE

CERTIFICATE OF CORRECTION

PATENT NO. : 5,647,485

DATED : July 15, 1997

INVENTOR(S) : Thomas V. Verrangia

It is certified that error appears in the above-identified patent and that said Letters Patent is hereby corrected as shown below:

Col. 3, line 25, "taps" should read -- tabs --;

Col. 3, line 50, "such" should read -- such that --;

Col. 4, line 28, "removeable" should read -- removably --; and

Col. 4, line 33, "removeable" should read -- removably--.

Signed and Sealed this

Twentieth Day of January, 1998

*Attest:*

*Attesting Officer*

BRUCE LEHMAN

*Commissioner of Patents and Trademarks*